US009145278B2

(12) United States Patent
Sasaki et al.

(10) Patent No.: US 9,145,278 B2
(45) Date of Patent: Sep. 29, 2015

(54) MEDIUM TRANSPORTATION DEVICE AND RECORDING APPARATUS

(71) Applicant: SEIKO EPSON CORPORATION, Tokyo (JP)

(72) Inventors: Tsuneyuki Sasaki, Matsumoto (JP); Yasuo Naramatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/165,303

(22) Filed: Jan. 27, 2014

(65) Prior Publication Data

US 2014/0218423 A1 Aug. 7, 2014

(30) Foreign Application Priority Data

Feb. 5, 2013 (JP) ..... 2013-020173

(51) Int. Cl.

| | |
|---|---|
| ***G01D 15/00*** | (2006.01) |
| ***B65H 23/04*** | (2006.01) |
| ***B65H 23/02*** | (2006.01) |

(52) U.S. Cl.

CPC ..... *B65H 23/04* (2013.01); *B65H 23/02* (2013.01); *B65H 2404/143* (2013.01); *B65H 2404/5311* (2013.01); *B65H 2551/25* (2013.01)

(58) Field of Classification Search

CPC . B41J 15/06–15/16; B41J 17/30; B41J 17/34; B41J 15/046; B65H 23/04; B65H 2402/143; B65H 2404/5311; B65H 2551/25; G01D 15/00

USPC ..... 242/419; 346/134, 135.1, 136

See application file for complete search history.

(56) References Cited

U.S. PATENT DOCUMENTS

| | | | | |
|---|---|---|---|---|
| 5,126,763 | A * | 6/1992 | Atherton et al. | 346/135.1 |
| 7,152,972 | B2 * | 12/2006 | King et al. | 347/104 |
| 2001/0021333 | A1 * | 9/2001 | Fujioka et al. | 400/624 |
| 2011/0129275 | A1 * | 6/2011 | Joseph et al. | 400/611 |

FOREIGN PATENT DOCUMENTS

| | | | |
|---|---|---|---|
| JP | 04-270672 | | 9/1992 |
| JP | 08-174928 | | 7/1996 |
| JP | 2004-107021 | | 4/2004 |
| JP | 2007-245599 | | 9/2007 |
| JP | 2007245599 | A * | 9/2007 |
| JP | 2008-094555 | | 4/2008 |
| JP | 2009-034900 | | 2/2009 |
| JP | 2009034900 | A * | 2/2009 |

* cited by examiner

*Primary Examiner* — Alessandro Amari
*Assistant Examiner* — Michael Konczal
(74) *Attorney, Agent, or Firm* — Workman Nydegger

(57) ABSTRACT

A medium transportation device includes a transportation section that transports a recording medium in a transport direction; a winding section that winds the recording medium transported by the transportation section; and a medium support section that is disposed between the transportation section and the winding section and has a medium support section supporting the recording medium. The medium support section has a support sliding section including a first surface and a second surface. A coefficient of friction of the first surface with the recording medium is greater than a coefficient of friction of the medium support surface with the recording medium and a coefficient of friction of the second surface with the recording medium is lower than the coefficient of friction of the first surface with the recording medium.

11 Claims, 4 Drawing Sheets

MEDIUM TRANSPORTATION DEVICE AND RECORDING APPARATUS

BACKGROUND

1. Technical Field

The present invention relates to a medium transportation device including a transportation section that transports a long medium and a winding section that winds the medium transported by the transportation section, and a recording apparatus.

2. Related Art

For example, a medium transportation device is disclosed in JP-A-2004-107021 (for example, FIG. 1 or the like), which includes a transportation section (a grip section) that transports a long recording medium sent out from a roll-shaped medium (for example, a roll paper) charged in a feeding section toward a downstream side while being clamped between a driving roller and a driven roller (a pinch roller), and a winding section (a winding scroller) that winds the recording medium transported by the transportation section toward the downstream side in a roll shape. A recording apparatus including the medium transportation device includes a recording section that performs recording (printing) on a portion of the recording medium on a medium support section (a platen) disposed on a downstream side from the transportation section. The recording medium, which is discharged along a paper guide after the printing is performed, is wound around the winding section while tension is applied to the recording medium by pressing a tension roller in a portion of the recording medium between the paper guide and the winding section.

Incidentally, there is a case where the recording medium is wound around the winding section in a position deviated in a width direction relative to a position clamped by the transportation section. In this case, if a biased force is propagated to an upstream side during the time of winding with the deviation of a winding position of the winding section in a width direction, the recording medium is deviated by the propagated force in the width direction in the transportation section and this causes skewing or meandering of the recording medium between the transportation section and the winding section.

For example, techniques for increasing a coefficient of friction of all or a part of a periphery of a roller (a transportation roller or a platen roller) configuring a transportation section are disclosed in JP-A-2007-245599 (for example, FIG. 5 or the like), JP-A-8-174928 (for example, paragraph [0010] or the like) and JP-A-4-270672 (for example, paragraph [0010], FIG. 2 or the like). For example, in JP-A-2007-245599, a friction applying member is formed in the transportation roller. In addition, in JP-A-8-174928, for example, a coefficient of friction of a surface of a rubber elastic body with the recording medium is a value of 0.4 to 0.6 obtained by coating a fluorine resin on the surface of the rubber elastic body coated on a core material of the platen roller. In addition, in JP-A-4-270672, a correcting roller is provided in which rubber rollers having a relatively large coefficient of friction are mounted on both ends thereof, and a belt skew correcting unit is provided which serves as a guide roller applying tension.

In the medium transportation device as described in JP-A-2004-107021, in which the winding section winds the recording medium, when the recording medium is biased and wound as described above, even if the deviation of the recording medium in the width direction is suppressed by the frictional resistance in a position of the transportation section away from the winding section on the upstream side, a large frictional resistance force is necessary to suppress the deviation thereof in the position of the transportation section on the upstream side, because a portion of the recording medium is largely deviated on the downstream side. In contrast, if the coefficient of friction of the roller is remarkably large, there is a concern that a catch thereon may occur during the time of transporting due to the remarkably large frictional resistance force of the recording medium received from the roller. If the catch of this type occurs, there is a problem in that the recording medium is inclined or the positional accuracy of the transportation is reduced without being transported with a required amount of the transportation.

Therefore, even if the coefficient of friction of all or some of the rollers is increased as described in JP-A-2007-245599, JP-A-8-174928 and JP-A-4-270672, it is difficult to sufficiently suppress skewing or meandering of the recording medium between the transportation section and the winding section, caused by biasing of the winding position of the recording medium in the winding section in a direction (width direction) intersecting the transport direction.

As a method to avoid such a problem and to suppress the skewing or the meandering of the recording medium between the transportation section and the winding section, the inventors of the invention found that a method is effective in which a medium support section (a discharging support section) for guiding the recording medium which is transported on a support surface between the transportation section and the winding section on the downstream side thereof is provided, and an elastic member having a frictional surface having a coefficient of friction with the recording medium greater than a coefficient of friction of the support surface with the recording medium is fixed to an end portion of the medium support section on the downstream side in the transport direction so as to extend in a width direction. According to the method in which the recording medium is transported so as to slide on the frictional surface of the elastic member, it is possible to suppress the skewing or the meandering of the recording medium between the transportation section and the winding section by suppressing the deviation of the recording medium in the width direction due to the relatively high coefficient of friction of the frictional surface with the recording medium.

However, in the method, there is a concern that a frictional force of the frictional surface of the elastic member fixed to the end portion of the support section on the downstream side in the transport direction so as to extend in the width direction is too excessive, the catch of the recording medium occurs during the time of transporting of the recording medium, the transport speed is unstable and then the positional accuracy of the transportation is reduced.

SUMMARY

The invention can be realized in the following forms or application examples.

Application Example 1

According to this application example, there is provided a medium transportation device including: a transportation section that transports a medium in a transport direction; a winding section that winds the medium transported by the transportation section; and a medium support section that is disposed between the transportation section and the winding section, and has a medium support surface supporting the medium, in which the medium support section includes a support sliding section having a first surface and a second surface, a coefficient of friction of the first surface with the medium is greater than a coefficient of friction of the medium support surface with the medium, and a coefficient of friction of the second surface with the medium is lower than the coefficient of friction of the first surface with the medium.

In this case, since the coefficient of friction of the first surface of the support sliding section with the medium on the downstream side of the medium support surface in the transport direction is greater than the coefficient of friction of the medium support surface with the medium on the upstream side in the transport direction, even if the winding position in the winding section is biased, it is easy to suppress propagation of the biased force to the upstream side in the transport direction of the medium in the support sliding section during the time of winding. Here, since the support sliding section has the first surface having the coefficient of friction with the medium greater than that of the medium support surface and the second surface having the coefficient of friction with the medium lower than that of the first surface, it is possible to suppress defects such as variations of the transport speed or stop of the transportation due to the catch of the medium during the time of transporting, which may occur if a front surface of the medium support surface of the support sliding section has a coefficient of friction as great as the first surface.

Therefore, it is possible to effectively suppress the deviation of the medium to be small between the transportation section and the winding section (for example, in the vicinity of the transportation section) in the direction (in the width direction) intersecting the transport direction, due to the propagation of the biased force to the upstream side in the transport direction of the medium during the time of winding, while maintaining the stability of the transport speed.

Application Example 2

In the medium transportation device according to the application example, a difference between a coefficient of static friction and a coefficient of dynamic friction between the first surface and the medium is preferably 0.1 or less.

In this case, the inventors of the invention found that an effect that suppresses the deviation of the medium to be small in the width direction is achieved in the medium transportation device having the configuration illustrated in the above application example.

In addition, in this case, since the difference between the coefficient of static friction and the coefficient of dynamic friction of the end portion of the medium support surface with the medium on the downstream side is as small as 0.1 or less, it is possible for the medium to move relatively smoothly from a stop state. For example, if the difference between the coefficient of static friction and the coefficient of dynamic friction is great, there is a concern that the catch occurs when the medium is moved from the stop state and, for example, the catch causes the deviation of the amount of the transportation on both ends of the medium in the width direction. However, since the difference between the coefficient of static friction and the coefficient of dynamic friction is as small as 0.1 or less, the catch does not occur and it is possible to suppress the deviation of the amount of the transportation, for example, on both ends of the medium in the width direction. Particularly, this is effective in a case of a configuration of an intermittently transporting system in which stopping and movement of the medium is frequently repeated.

Application Example 3

In the medium transportation device according to the application example, the support sliding section preferably has a plurality of protruding sections including the first surfaces and is disposed at intervals in a direction intersecting the transport direction, and the protruding sections preferably have sides along the transport direction.

In this case, an effect in which the deviation of the medium is unlikely to occur in the direction (width direction of the medium) intersecting the transport direction by bringing the medium into line contact with the two sides of the protruding section facing each other in the transport direction is achieved. Therefore, even if the coefficient of friction of the first surface with the medium is suppressed to be small, it is possible to suppress the deviation of the medium in the width direction during the time of transporting and it is possible to suppress the deviation of the medium to be small in the width direction due to the propagation of the biased force to the upstream side in the transport direction of the medium during the time of winding.

Application Example 4

In the medium transportation device according to the application example, a length of the first surface is preferably 20 mm or greater and a length of the second surface is preferably 40 mm or greater in the direction intersecting the transport direction.

In this case, the inventors of the invention found that an effect that suppresses the deviation of the medium to be small in the width direction is achieved while maintaining the stability of the transportation of the medium in the medium transportation device having the configuration illustrated in the above application example.

Application Example 5

In the medium transportation device according to the application example, a total length of the plurality of first surfaces in the direction intersecting the transport direction is preferably ½ or less of the length of the support sliding section in the direction intersecting the transport direction.

In this case, the inventors of the invention found that an effect that suppresses the deviation of the medium to be small in the width direction is achieved while maintaining the stability of the transportation of the medium in the medium transportation device having the configuration illustrated in the above application example. For example, if the support sliding section is configured on the first surface by bonding the protruding section formed of a material having a suitable coefficient of friction to the base portion having the second surface, it is possible to reduce costs thereof because the amount of the forming material of the protruding section can be reduced.

Application Example 6

In the medium transportation device according to the application example, a distance between the first surface and the second surface in a thickness direction of the medium is preferably 0.1 mm or greater.

In this case, the inventors of the invention found that, for example, if the protruding section is a ridge along the transport direction, an effect caused by making the coefficient of friction of the first surface with the recording medium greater than that of the medium support surface and an effect in which the deviation of the recording medium is unlikely to occur in the direction (the width direction of the medium) intersecting the transport direction by bringing the medium into line contact with both ends of the ridge (the protruding section) in the transport direction are achieved.

Application Example 7

In the medium transportation device according to the application example, the protruding section is preferably formed by an elastic member.

In this case, a sliding surface of the medium is unlikely to be scratched by the elasticity of the elastic member while suppressing the deviation of the medium in the width direction or the propagation of the bias of the winding section by applying a required sliding resistance to the medium.

Application Example 8

In the medium transportation device according to the application example, if widths of the medium in the direction intersecting the transport direction are 16 inches, 24 inches, 36 inches, 48 inches, 53 inches, 61 inches and 64 inches, the protruding sections are preferably disposed such that an end portion of the medium having at least one of those widths in the direction intersecting the transport direction is supported on the first surface.

Since the sizes listed in the application example are standard specification sizes of the recording media, the effect that suppresses the deviation of the medium in the width direction during the time of transporting by supporting the end portion of the medium in the width direction on the first surface having a relatively great coefficient of friction with the medium is further remarkably achieved by disposing the protruding section so that the end portion of the medium having at least one of the widths described above in the width direction is supported on the first surface.

Application Example 9

In the medium transportation device according to the application example, in every case where the widths of the medium which is supported in the support sliding section in the direction intersecting the transport direction are 16 inches, 24 inches, 36 inches, 48 inches, 53 inches, 61 inches and 64 inches, the protruding sections are preferably disposed such that the end portion of the medium in the direction intersecting the transport direction is supported on the first surface.

In this case, it is possible to supply the highly versatile medium transportation device which achieves a further remarkable effect that suppresses the deviation of the medium in the width direction during the time of transporting by supporting the end portion of the medium in the width direction on the first surface having a relatively great coefficient of friction with the medium with respect to the recording medium of various sizes in the standard specification of the recording media.

Application Example 10

In the medium transportation device according to the application example, the first surface is preferably continuous with the medium support surface.

In this case, stress such as the catch which occurs in the medium during the time of transporting is suppressed and then stable transportation can be performed.

Application Example 11

According to this application example, there is provided a recording apparatus including: a recording section that performs recording on a medium; a transportation section that transports the medium in a transport direction; a winding section that winds the medium transported by the transportation section; and a medium support section that is disposed between the transportation section and the winding section, and has a medium support surface supporting the medium, in which the medium support section has a plurality of protruding sections that include first surfaces having a coefficient of friction with the medium greater than that of the medium support surface and disposed at intervals in a direction intersecting the transport direction; and a support sliding section formed of a second surface having a coefficient of friction with the medium lower than that of the first surface.

In this case, since the coefficient of friction of the first surface of the support sliding section with the medium on the downstream side of the medium support surface in the transport direction is greater than the coefficient of friction of the medium support surface with the medium on the upstream side in the transport direction, even if the winding position in the winding section is biased, it is easy to suppress propagation of the biased force to the upstream side in the transport direction of the medium in the support sliding section during the time of winding. Here, since the support sliding section has the first surface having the coefficient of friction with the medium greater than that of the medium support surface and the second surface having the coefficient of friction with the medium lower than that of the first surface, it is possible to suppress defects such as variations of the transport speed or stop of the transportation due to the catch of the medium during the time of transporting, which may occur if a front surface of the medium support surface of the support sliding section has a coefficient of friction as great as the first surface.

Therefore, it is possible to effectively suppress the deviation of the medium to be small between the transportation section and the winding section (for example, in the vicinity of the transportation section) in the direction (the width direction) intersecting the transport direction, due to the propagation of the biased force to the upstream side in the transport direction of the medium during the time of winding, while maintaining the stability of the transport speed.

Therefore, since the deviation of the medium during the time of transporting in the width direction or the propagation of the bias of the medium in the winding section to the upstream side including the recording section is suppressed and the stability of the transportation of the recording section can be maintained, it is possible to supply the recording apparatus capable of suppressing the degradation of the image quality due to unstable transportation of the medium and performing the recording having excellent image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment embodying the invention will be described with reference to the drawings. In addition, in each view described below, each member or the like is illustrated on a scale different from an actual scale thereof to make a size of each member or the like of a recognizable size.

Figure 1:
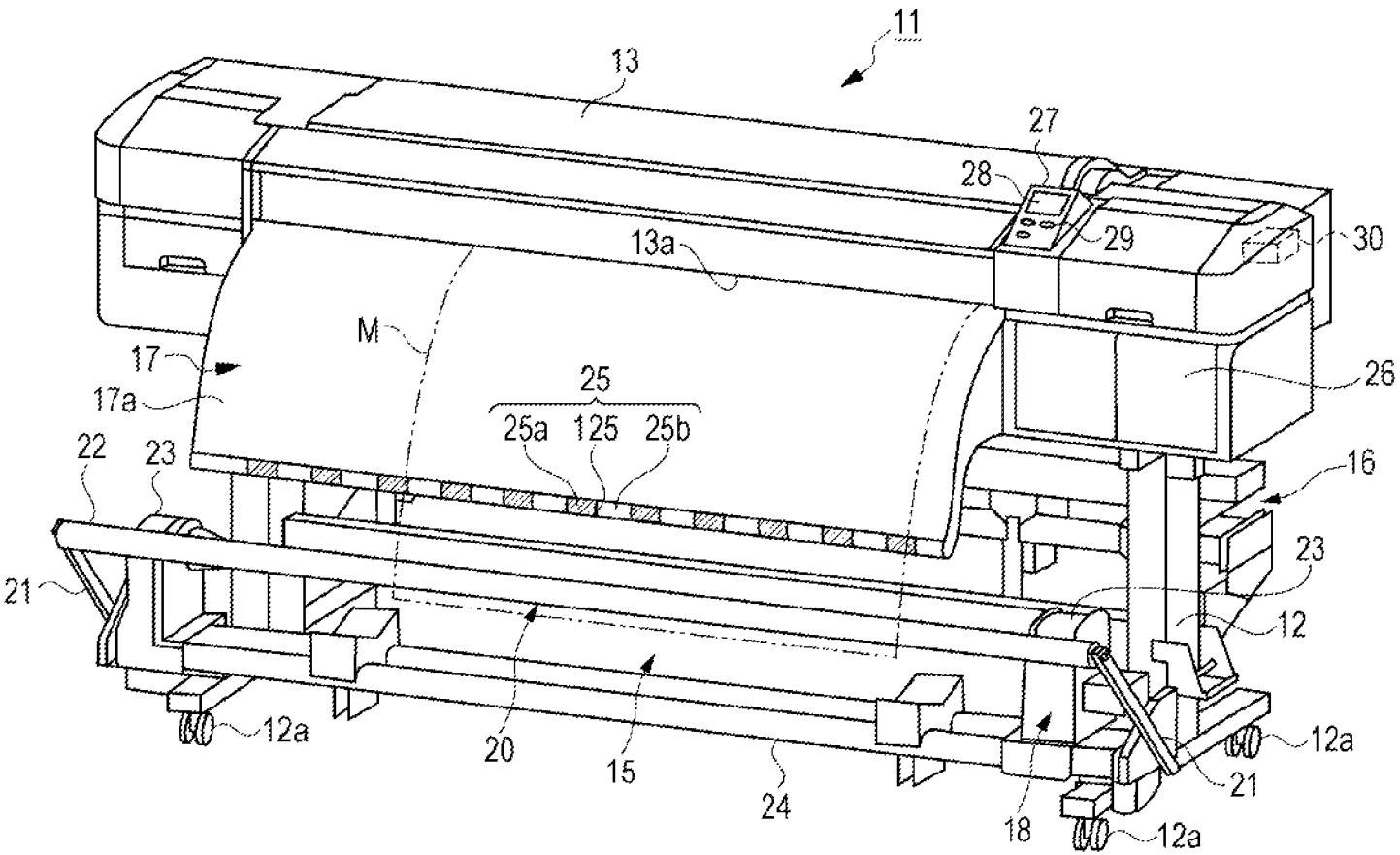
FIG. 1 is a perspective view of a printer as a recording apparatus according to an embodiment.
Figure 2:
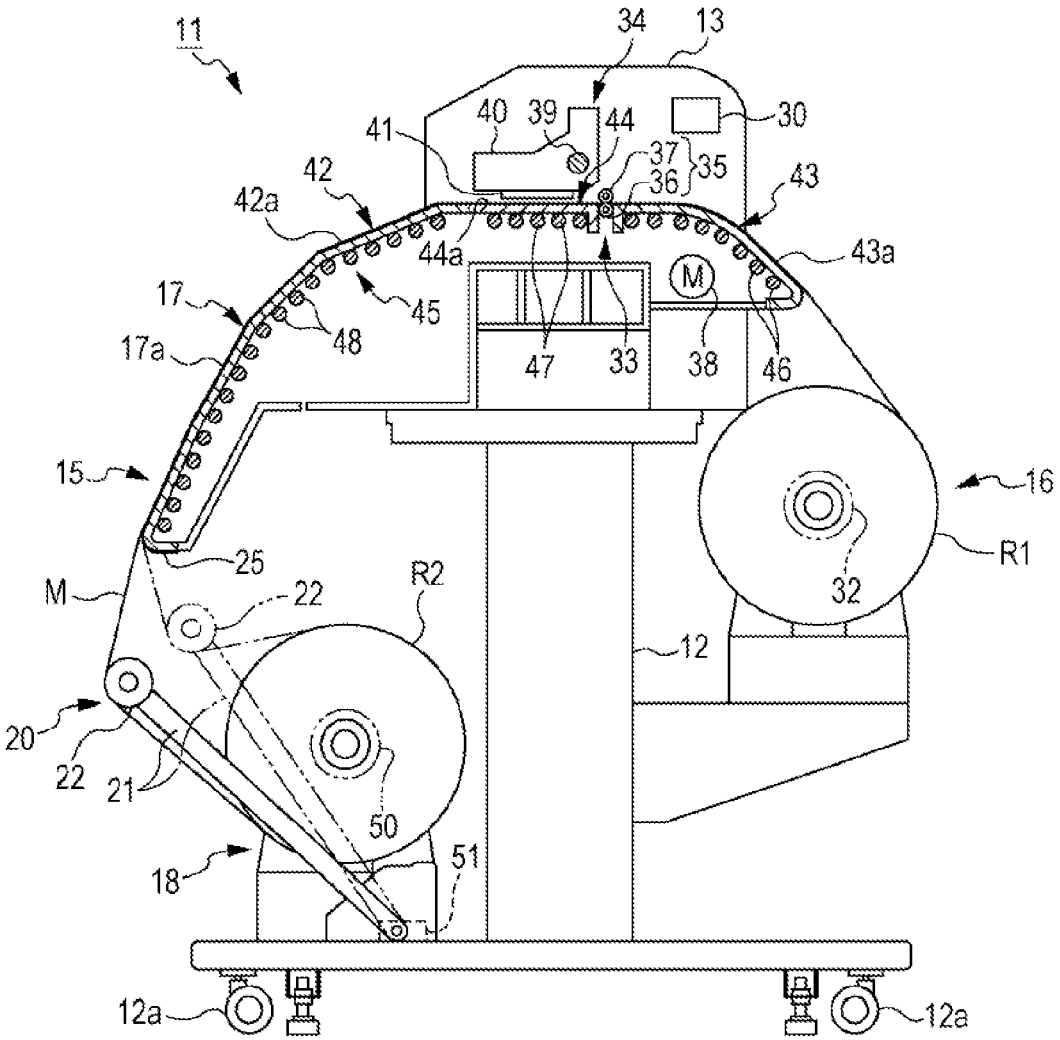
FIG. 2 is a side cross-sectional view of a printer.

FIG. 1 is a perspective view of a printer as a recording apparatus according to an embodiment. FIG. 2 is a side cross-sectional view of a printer.

A printer 11 as an example of the recording apparatus illustrated in FIG. 1 is, for example, a large format printer (LFP) dealing with a recording medium M as an example of a medium of a relatively large size such as an A0 size or a B0 size of JIS standard. The recording medium M is a long sheet having a predetermined width and, for example, is made of resin film, paper or the like.

As illustrated in FIG. 1, the printer 11 includes a foot stand 12 (a stand) having a plurality of casters 12*a* in a lower end thereof and a body 13 which is in a substantially rectangular parallelepiped shape and is supported on the foot stand 12. In addition, the printer 11 includes a medium transportation device 15 transporting the long recording medium M in a roll-to-roll method.

The medium transportation device 15 includes a feeding section 16 provided on a lower back side of the body 13, a discharging support section 17 which supports the recording medium M discharged from a discharging slot 13*a* of the body 13 with a support surface 17*a* after the recording medium M is fed into the body 13 from the feeding section 16 and then printing is performed on the recording medium M, and a winding section 18 which winds the recording medium M after the printing is performed on a roll body R2 (see FIG. 2) on a downstream side thereof on a transportation path. The discharging support section 17 of the example extends obliquely downward from a lower side of the discharging slot 13*a* of the body 13 and the support surface 17*a* thereof is formed in a curved surface which is slightly bulged forward. The recording medium M after the printing is performed is guided obliquely downward along the support surface 17*a* thereof. Then, the winding section 18 is disposed on the lower side of the discharging support section 17 in a state of being supported in the foot stand 12. In addition, in the embodiment, an example of the medium support section is configured by the discharging support section 17 and an example of the medium support surface is configured by the support surface 17*a*.

A tensioning mechanism 20 which applies tension to a portion of the recording medium M between the discharging support section 17 and the winding section 18 is provided in the vicinity of the winding section 18. The tensioning mechanism 20 includes a pair of arm members 21 rotatably supported on the lower portion of the foot stand 12 and a tension roller 22 as an example of a pressing section rotatably supported on leading end portions of the pair of arm members 21. The tension roller 22 has a shaft length which is longer than an assumed maximum width of the recording medium M and the recording medium M can be wound in a state where the winding section 18 is tensioned by bringing the tension roller 22 to contact and press a back surface and an entire area of the recording medium M in the width direction thereof (a direction orthogonal to a paper surface of FIG. 1).

The winding section 18 includes a pair of holders 23 which clamps a core material (not illustrated) (for example, a paper tube) winding the recording medium M after the printing is performed in a roll shape from both sides in an axial direction. The gap between the pair of holders 23 can be adjusted at intervals according to the width of the recording medium M by moving one of the holders 23 along a rail 24 in the width direction. In contrast, the recording medium M is wound in the roll shape on the core material installed between the pair of holders 23 by rotating the holder 23 of one side (right side in FIG. 1). Moreover, the winding section 18 of the embodiment is a spindle-less type in which a spindle is not used but may be a type in which the spindle is used.

As illustrated in FIG. 1, a support sliding section 25 is disposed in an end portion of the support surface 17*a* of the discharging support section 17 on the downstream side in the transport direction. The support sliding section 25 supports the recording medium M having a coefficient of friction with the medium greater than that of the support surface 17*a* and is a sliding section of the recording medium M when the recording medium M is transported. As an example, the support sliding section 25 has elastic members 125 and a second surface 25*b*. The elastic members 125 include the first surfaces 25*a* supporting the recording medium M having a coefficient of friction with the recording medium M greater than that of the support surface 17*a*, and form a plurality of protruding sections disposed at constant intervals in a direction intersecting the transport direction. The second surface 25*b* is located between adjacent elastic members 125 and has a coefficient of friction with the recording medium M lower than that of the first surface 25*a*. In other words, the medium support section has a support sliding section including the first surface and the second surface, and the coefficient of friction between the first surface and the medium is greater than the coefficient of friction between the medium support surface and the medium. The coefficient of friction between the second surface and the medium is lower than the coefficient of friction between the first surface and the medium.

Moreover, a protruding section protrudes with respect to the second surface in a direction of the medium to be supported. Here, the elastic member 125 forming the protruding section is configured of a member having elasticity of which a coefficient of friction with the recording medium M is relatively high (the support sliding section 25 is described below in detail).

In addition, an ink cartridge container 26 capable of being loaded with ink cartridges (not illustrated), an operation panel 27 or the like is provided in a portion of the body 13 on a right side in FIG. 1. The operation panel 27 includes a display section 28 on which a printing condition setting screen or the like is displayed and an operation section 29 that is operated when inputting the printing condition or the like and when applying various instructions. Furthermore, a controller 30 controlling an entire operation of the printer 11 is provided in the body 13.

Next, a detailed configuration of the printer 11 is described based on FIG. 2. As illustrated in FIG. 2, the feeding section 16 includes a feeding motor 32 that outputs a rotational power to one of a pair of holders (not illustrated) pinching a roll body R1 in the axial direction thereof. The recording medium M is sent out into the body 13 by rotating the roll body R1 in a sending out direction by driving the feeding motor 32.

A transportation section 33 that transports the recording medium M in the transport direction and a recording section 34 that is positioned on the downstream side from the transportation section 33 in the transport direction and performs recording (printing) on the recording medium M are provided in the body 13. The transportation section 33 includes a transportation roller pair 35 that transports the recording medium M while clamping (nipping) the recording medium M. The transportation roller pair 35 includes a transportation driving roller 36 that is disposed on a lower side of a transportation path and is driven to rotate, and a transportation driven roller 37 that is disposed on an upper side of the transportation path and is rotated by the rotation of the transportation driving roller 36. A transportation motor 38 that is a power source outputting a rotation power to the transportation driving roller 36 is provided in the body 13. The recording medium M that is clamped between both rollers 36 and 37 is transported on the downstream side in the transport direction by rotating the transportation driving roller 36 by driving the transportation motor 38.

As illustrated in FIG. 2, the recording section 34 includes a carriage 40 that reciprocates in a main scanning direction (a direction intersecting a paper surface in FIG. 2) intersecting the transport direction of the recording medium M along a guide shaft 39 installed in the body 13. The carriage 40 is fixed to an endless timing belt (not illustrated) to which the power of a carriage motor (not illustrated) is transmitted and can reciprocally move in the main scanning direction by forward and reverse driving of the carriage motor. The carriage 40 has a recording head 41 disposed facing the transportation path. The printing is performed on the recording medium M by ejecting the ink supplied from the ink cartridge (not illustrated) from nozzles of the recording head 41 while the carriage 40 moves in the main scanning direction. At this time, in a printing operation, a recording operation that ejects ink droplets from the recording head 41 while the carriage 40 moves in the main scanning direction and a transporting operation that transports the recording medium M to the next recording position in the transport direction are substantially alternately performed. Therefore, the printing of the image is performed on the recording medium M based on printing data. As described above, in the printer 11, when the printing is performed, for one pass in which the carriage 40 moves one time in the main scanning direction, intermittent transportation of one time of the recording medium M is performed with a transport distance of one pass to the implementation position of the next pass.

A support member 42 having a support surface 42*a* for supporting the recording medium M is provided between the feeding section 16 and the winding section 18. Therefore, the recording medium M is curved to protrude upward by the support surface 42*a*. The support member 42 is configured by assembling a plurality of members having a predetermined shape which are formed by a bending process of a plate material made of sheet metal or the like.

The support member 42 includes a feeding support section 43 that supports the recording medium M fed from the roll body R1 on a support surface 43*a*, a recording support section 44 that supports a portion of the recording medium M which is a printing region by the recording head 41 on a support surface 44*a*, and the discharging support section 17 described above having the support surface 17*a* for guiding the recording medium M after the printing is performed from the body 13 to a lower front side (a lower left side in FIG. 2). Each of the support sections 43, 44 and 17 is disposed in a state of being continuously connected to the support surfaces 43*a*, 44*a* and 17*a*, respectively, on a substantially same surface.

As illustrated in FIG. 2, a heating section 45 for heating the support surface 42*a* is provided on a back side of the support member 42. The heating section 45 includes a preheater 46 for preheating the recording medium M in the feeding on the support surface 43*a*, a platen heater 47 for heating the recording medium M in the printing on the support surface 44*a*, and an after heater 48 for drying the ink deposited on the recording medium M by heating the recording medium M on the support surface 17*a* after the printing is performed. The heating section 45 has a function of increasing printing quality by preventing blending or blurring of the ink by quickly drying and fixing the ink on the recording medium M.

As illustrated in FIG. 2, the winding section 18 includes a winding motor 50 that outputs the rotational power to one of the pair of holders 23 (see FIG. 1) which pinch the roll body R2 in the axial direction. The recording medium M is wound around the roll body R2 by rotating the roll body R2 in the winding direction with the driving of the winding motor 50. Each of the motors 32, 38 and 50 is electrically connected to the controller 30 in the body 13. The controller 30 of the example controls a velocity of each of the motors 32, 38 and 50, for example, using a pulse width modulation control (PWM control). Of course, the motor control method by the controller 30 can be changed to an appropriate control method.

In addition, a sensor 51 for detecting a tilt angle of the arm members 21 is provided in a base end portion of one of the arm members 21 supporting the tension roller 22. The controller 30 controls the winding motor 50, based on a detection signal indicating the tilt angle which is input from the sensor 51 so that the tilt angle of the arm members 21 is within a predetermined range. The recording medium M after the printing is performed is wound around the roll body R2 in a state where the tension of a substantially constant range is applied by the control of the winding motor 50.

As illustrated in FIG. 2, the tilt angle of the arm members 21 is changed depending on a difference in the winding direction of the recording medium M to the roll body R2. That is, if the winding direction of the recording medium M to the roll body R2 is "outer winding" indicated by a solid line in FIG. 2, the arm members 21 that support the tension roller 22 pressing the recording medium M are tilted forward (left side in FIG. 2) and the recording medium M that reaches the roll body R2 from the discharging support section 17 through the tension roller 22 takes the transportation path indicated by the solid line in FIG. 2. In contrast, if the winding direction of the recording medium M to the roll body R2 is "inner winding" indicated in a two-dot chain line in FIG. 2, the arm member 21 that supports the tension roller 22 pressing the recording medium M takes the tilt angle slightly rotated backward (right side in FIG. 2), compared to the outer winding. Thus, the recording medium M that reaches the roll body R2 from the discharging support section 17 through the tension roller 22 takes the transportation path indicated in the two-dot chain line in FIG. 2. In addition, the position of the tension roller 22 also changes depending on the change in the winding diameter of the roll body R2. If the roll body R2 has the assumed maximum diameter in FIG. 2, the transportation path between the discharging support section 17 and the tension roller 22 takes the transportation path within a range between the transportation path indicated in the solid line in FIG. 2 close to the outermost side and the transportation path indicated in the two-dot chain line in FIG. 2 close to the innermost side.

In addition, in the printer 11 of the embodiment, the recording medium M may be wound around the roll body R2 and the recording medium M may be discharged without being wound. In the latter case, the recording medium M after the printing is performed hangs down from the end portion of the discharging support section 17 on the downstream side and, for example, is accommodated in a discharging basket (not illustrated).

Figure 3A:
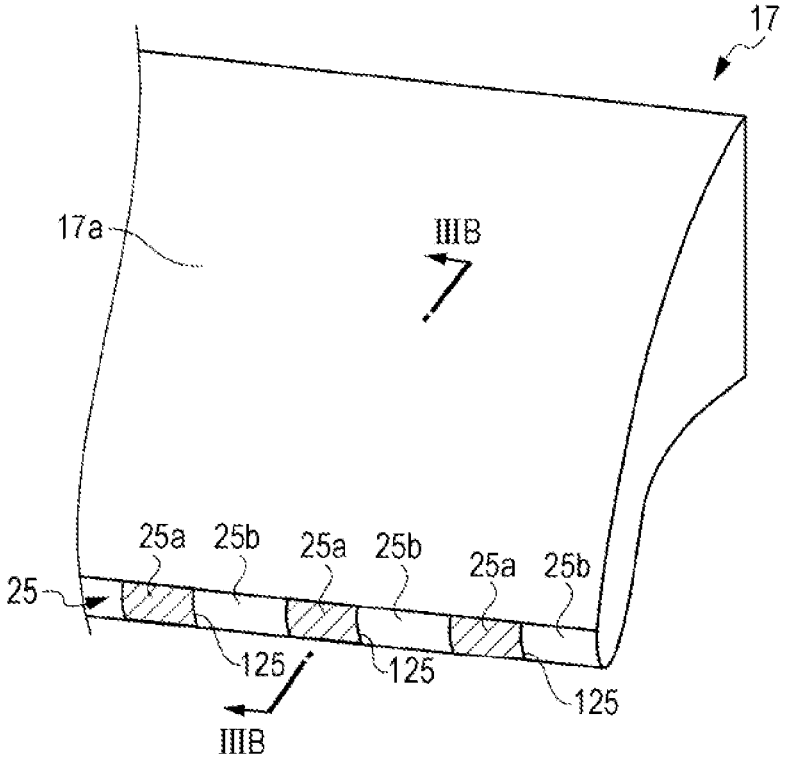
FIG. 3A is a partial perspective view illustrating an enlarged part of a discharging support section and FIG. 3B is a schematic side cross-sectional view taken along line IIIB-IIIB in FIG. 3A and illustrating an enlarged support sliding section of a discharging support section.
Figure 3B:
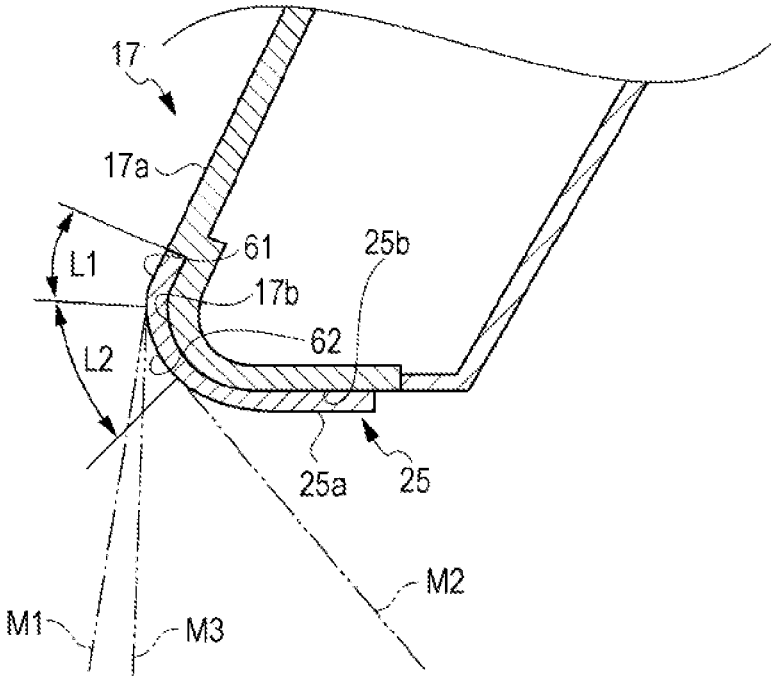
Figure 4A:
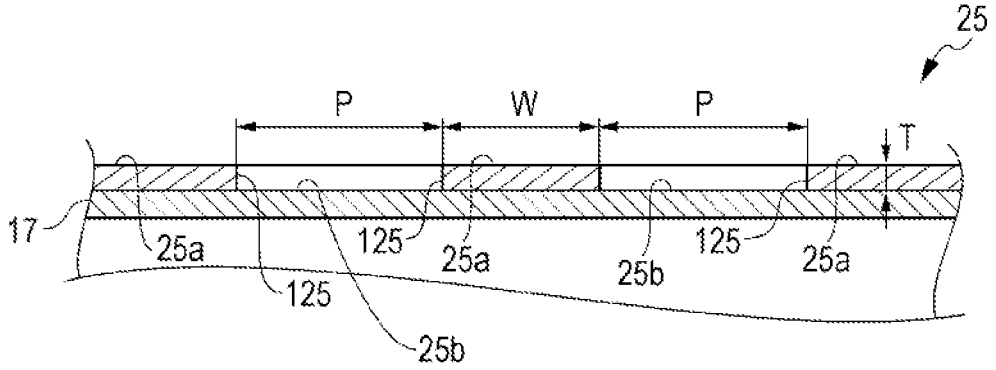
FIG. 4A is a partial cross-sectional view schematically illustrating an enlarged main portion of the support sliding section and FIG. 4B is a schematic side cross-sectional view illustrating a state of the support sliding section of FIG. 4A when a medium is transported.
Figure 4B:
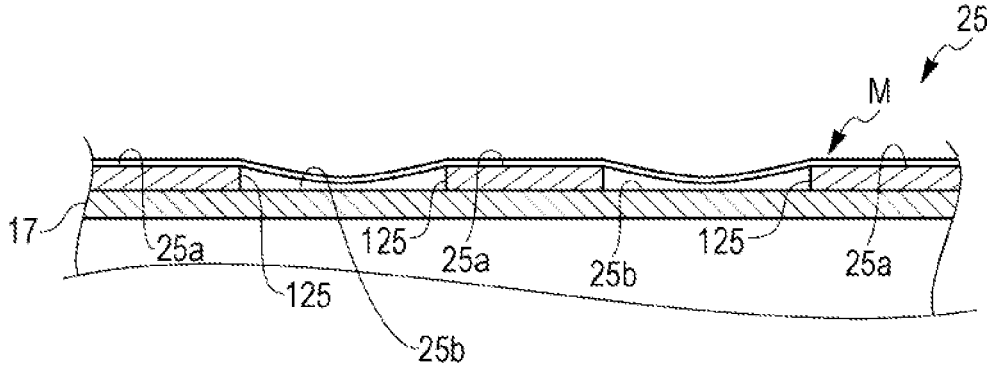

Here, the support sliding section 25 disposed on the downstream side of the discharging support section 17 in the transport direction is described in detail with reference to FIGS. 3A to 4B. FIG. 3A is a partial perspective view illustrating an enlarged part of the discharging support section 17 and FIG. 3B is a schematic side cross-sectional view taken along line IIIB-IIIB in FIG. 3A and illustrating the enlarged support sliding section 25 of the discharging support section 17. FIG. 4A is a partial cross-sectional view schematically illustrating an enlarged main portion of the support sliding section 25 and FIG. 4B is a schematic side cross-sectional view illustrating a state of the support sliding section 25 of FIG. 4A when the recording medium M is transported.

As illustrated in FIG. 3A, the support sliding section 25 is located on the downstream side (lower side in FIG. 3A) of the discharging support section 17 in the transport direction. The support sliding section 25 has a plurality of elastic members 125 that have the first surfaces 25*a* supporting the recording medium M and having the coefficient of friction with the recording medium M greater than that of the support surface 17*a* and are disposed at constant intervals in the direction intersecting the transport direction, and the second surface 25*b* that is located between adjacent the elastic members 125 and has the coefficient of friction with the recording medium M lower than that of the first surface 25*a*. The elastic member 125 is in a substantially rectangular shape of which two sides facing each other in a plan view are located along the transport direction and the adjacent elastic members 125 are disposed substantially parallel to each other. In other words, the support sliding sections are disposed at intervals in the direction intersecting the transport direction and have the protruding sections including the first surfaces. The protruding section has sides along the transport direction. Moreover, the number of sides of the protruding section along the transport direction may not be two and may be at least one.

In the elastic members 125, the inventors of the invention found that a total length of the plurality of first surfaces 25*a* is preferably ½ or less with respect to a length of the support sliding section 25 in the direction (in a left and right direction declining on the right side in FIG. 3A) intersecting the transport direction and desired effects of the invention are sufficiently achieved even if the length thereof is ⅓ (also, see FIG. 1). As described above, it is possible to reduce the cost by decreasing an amount of a forming material of the elastic member 125 as the protruding section having the first surface 25*a* when forming the support sliding section 25.

As illustrated in FIG. 3B, the transportation path (also see FIG. 2) between the discharging support section 17 and the tension roller 22 moves in a range between when taking a path M1 close (close to the left side in FIG. 3B) to the outermost side during the time of the outer winding and when taking a path M2 close (close to the right side in FIG. 3B) to the innermost side during the time of the inner winding. Then, the support sliding section 25 is provided such that the recording medium M slides only using the support sliding section 25 with respect to the end portion of the support surface 17*a* on the downstream side even if the recording medium M takes any transportation path within the range. Moreover, the support sliding section 25 including the elastic members 125 is also provided in a region which does not come into contact with the recording medium M in the end surface of the discharging support section 17 on the downstream side.

In the end portion of the discharging support section 17 on the downstream side in the transport direction, a stepped concave section 17*b* having a depth which is substantially the same as a tape width of the elastic member 125 is formed throughout an entirety thereof in the width direction. The elastic member 125 is bonded to the concave section 17*b*. Here, the concave section 17*b* forms the second surface 25*b* in the support sliding section 25. That is, the first surface 25*a* most protruding on the side of the recording medium M in the support sliding section 25 is continuous with the support surface 17*a* of the discharging support section 17 that is the surface on an upstream side from the first surface 25*a* in the transport direction. Thus, stress such as a catch which may occur in the recording medium M during the time of transporting by the support sliding section 25 is suppressed and then stable transportation can be performed. Here, if the support surface 17*a* of the discharging support section 17 that is a surface on the upstream side from the first surface 25*a* in the transport direction is continuous in a substantially flat manner, further stable transportation can be performed.

In the support sliding section 25, the first surface 25*a* of the elastic member 125 has a substantially flat first support surface section 61 and a convex-curved second support surface section 62. The first support surface section 61 extends to the downstream side substantially parallel to the upstream side from the first surface 25*a* in the support surface 17*a*. The second support surface section 62 is continuous with the first support surface section 61 on the downstream side and curves to a side away from the recording medium M when the recording medium M is positioned on the first support surface section 61. If the recording medium M is discharged without winding, as illustrated in FIG. 3B, the recording medium M takes a path M3 which hangs down substantially in the direction of gravity from the end portion of the discharging support section 17 on downstream side. The first support surface section 61 is a sliding surface on which the recording medium M discharged without winding by the winding section 18 and the recording medium M wound by the winding section 18 slide together. In addition, the second support surface section 62 is a sliding surface on which the recording medium M that is discharged without winding by the winding section 18 does not slide but the recording medium M that is wound by the winding section 18 slides. That is, the second support surface section 62 is provided throughout a range in which the sliding position of the recording medium M with respect to the support surface 17*a* is changed due to the change in the transportation path between the discharging support section 17 and the tension roller 22. However, in the example, in the recording medium M which is wound, the recording medium M takes the path on the side of the path M2 rather than the path M3 slides on the second support surface section 62.

Then, as illustrated in FIG. 3B, a length L1 of the first support surface section 61 in the transport direction is shorter than a length L2 of the second support surface section 62 in the transport direction. As an example, the length L1 is a predetermined value within a range of 1 mm to 10 mm. The reason for this is to suppress the catch of the recording medium M due to a sliding resistance received from the first surface 25*a* by narrowing a sliding area of the recording medium M with the first surface 25*a*, which is discharged without winding by shortening the length L1. In most cases where the recording medium M which is wound takes the path on the side of the path M2 rather than on the side of the path M3, the sliding resistance of the recording medium M which is received from the first surface 25*a* is relatively increased by applying the sliding area with the first support surface section 61 to the sliding area with at least a part of the second support surface section 62. In addition, in the recording medium M which is wound, the recording medium M taking the path on the side of the path M1 rather than on the side of the path M3 can also receive the sliding resistance by sliding on most parts of the first support surface section 61. Moreover, in the embodiment, an example of the medium support section is configured by the discharging support section 17 including the support sliding section 25. An example of the medium support surface is configured by the support surface 17*a* including the first surface 25*a* and the second surface 25*b*.

Hereinafter, a configuration of a main portion of the support sliding section 25 according to the embodiment is described in detail with reference to FIGS. 4A and 4B.

In the support sliding section 25 illustrated in FIGS. 4A and 4B, the plurality of elastic members 125 are disposed on the second surface 25*b* formed in the discharging support section 17. The elastic members 125 have a width W (a length of the first surface 25*a*) with a predetermined interval P in the direction (left and right direction in FIGS. 4A and 4B) intersecting the transport direction. In the direction intersecting the transport direction, the length (width) of the first surface 25*a* of the elastic member 125 is preferably 20 mm or greater and the interval P between adjacent elastic members 125, that is, the length of the second surface 25*b*, is preferably 40 mm or greater. According to the configuration, in the printer 11 (medium transportation device 15) having the configuration illustrated in the embodiment, the inventors of the invention found that an effect that suppresses the deviation of the medium M to be small in the width direction is achieved while maintaining the stability of the transportation of the recording medium M.

In addition, in the support sliding section 25 illustrated in FIG. 4A, the distance between the first surface 25*a* and the second surface 25*b* in the thickness direction of the recording medium M, that is, the thickness of the elastic member 125 as the protruding section, is preferably 0.1 mm or greater. The inventors of the invention found that if the configuration is satisfied, there are many effects. That is, an effect caused by relatively increasing the coefficient of friction of the first surface 25*a* with the recording medium M and an effect in which the deviation of the recording medium M is unlikely to occur in the direction (left and right direction in FIG. 4B) intersecting the transport direction by bringing the recording medium M into line contact with both ends of the elastic member (the protruding section) 125 in the transport direction when the recording medium M slides while being supported on the support sliding section 25 as illustrated in FIG. 4B are sufficiently achieved.

Moreover, FIG. 4B illustrates an aspect in which the recording medium M is held on the first surface 25*a* of the elastic member 125 as the protruding section of the support sliding section 25 and does not come into contact with the second surface 25*b*. However, the recording medium M may be supported (contacted) on both of the first surface 25*a* and the second surface 25*b*. Since the coefficient of friction of the second surface 25*b* with the medium is lower than that of the first surface 25*a*, as described above, there are almost no negative effects to the effect of suppressing the deviation of the recording medium M in the width direction and variations of a transport speed by the elastic member 125 having the first surface 25*a*.

In addition, in the printer 11 (the medium transportation device 15) according to the embodiment, if the widths of the recording medium M supported on the support sliding section 25 in the direction (width direction) intersecting the transport direction are 16 inches, 24 inches, 36 inches, 48 inches, 53 inches, 61 inches and 64 inches, the elastic member 125 as the protruding section is preferably disposed such that the end portion of the recording medium M having at least one of those widths in the direction intersecting the transport direction is supported on the first surface 25*a*. In addition, of course, the configuration described above is preferably applied in as many cases as possibly in which the recording medium M has the plurality of widths described above as much as possible. In all cases of 16 inches, 24 inches, 36 inches, 48 inches, 53 inches, 61 inches and 64 inches, the elastic member 125 is preferably disposed so that the end portion of the recording medium M in the direction intersecting the transport direction is supported on the first surface 25*a*. Here, the end portion supported on the first surface 25*a* may be the end portion of one side but displacement of the recording medium M in the direction intersecting the transport direction can be effectively suppressed if both ends are supported.

Since the sizes described above are standard specification sizes of the recording media, the effect that suppresses the deviation of the recording medium M in the width direction is further remarkably achieved during the time of transporting by supporting the end portion of the recording medium M on the first surface 25*a* having a relatively great coefficient of friction with the recording medium M with the line contact in the width direction by disposing the elastic member 125 in a manner that the both ends of the recording medium M of the widths described above as much as possible in the width direction are supported on the first surface 25*a*. In addition, it is possible to supply the printer 11 (medium transportation device 15) having a high general purpose which achieves the further remarkable effect that suppresses the deviation of the recording medium M in the width direction with respect to the recording medium M of various sizes in the standard specification of the recording media.

Next, an operation of the printer 11 having above configuration is described.

When starting the printing in the printer 11, the recording medium M is sent out from the roll body R1 of the feeding section 16. The recording medium M which is sent out is transported along the support surface 42*a* of the support member 42. In the body 13, the printing of the image or the like is performed on the recording medium M by ejecting the ink from the recording head 41. At this time, in the printing, the recording operation for ejecting ink droplets from the recording head 41 while the carriage 40 moves in the main scanning direction and the transporting operation for transporting the recording medium M to the next recording position in the transport direction are substantially alternately performed. Therefore, the printing of the image is performed on the recording medium M based on printing data.

The recording medium M after the printing is performed is transported along the support surface 17*a* of the discharging support section 17 and, at this time, the image printed on the recording medium M is fixed by heating the recording medium M on the support surface 17*a* with heat of the after heater 48 and by drying the ink deposited on the upper surface thereof.

In addition, the recording medium M is transported while sliding on the first surface 25*a* formed by the elastic member 125 in the end portion of the discharging support section 17 in the downstream side. In addition, the recording medium M between the discharging support section 17 and the winding section 18 is wound around the roll body R2 by the winding section 18 in a state where the recording medium M is tensioned by being pressed with the tension roller 22 on the back surface thereof.

For example, if the recording medium M is biased and wound around the roll body R2, a biased force during the time of winding thereof is propagated to the upstream side in the transport direction. The biased force of this type results in skew of the recording medium M and causes degradation of printing quality due to the deviation of a landing position of the ink droplet ejected from the recording head 41. In addition, if the recording medium M is wound around the roll body R2 in a biased position in the axial direction thereof, the recording medium M is wound around the roll body R2 while being deviated little by little in one direction in the axial direction of the roll body R2, and during the time of winding on the roll body R2 to a certain extent, at this time, the recording medium M is wound around the roll body R2 while being deviated little by little in a direction (the converse direction) other than the axial direction of the roll body R2. Then, the recording medium M meanders between the transportation section 33 and the winding section 18 by substantially alternately repeating the winding.

In the embodiment, even if a force that displaces the recording medium M in the width direction is operated, the recording medium M is unlikely to slip in the width direction in spite of the force due to receiving appropriately high sliding resistance with the first surface 25*a* of the elastic member 125 at the locations of the support sliding section 25 on which the recording medium M slides and by bringing the recording medium M into line contact with the two sides facing each other along the transport direction of the elastic member 125 having the rectangular shape in a plan view. Thus, the force which causes the recording medium M to deviate in the width direction is unlikely to propagate to the upstream side of the support sliding section 25 in the transportation path. Therefore, the deviation of the position of the recording medium M at which the recording head 41 performs the printing in the printing region is unlikely to occur in the width direction. In addition, for example, the catch in transporting which may occur in a case where the entire surface of the recording medium M in the width direction is supported on the first surface 25*a* by supporting not the entire surface but a part of the recording medium M in the width direction with the first surface 25*a* of the elastic member 125 having a relatively high coefficient of friction with the recording medium M is suppressed. As a result, even if the recording medium M is biased and wound around the winding section 18, since the positional accuracy and the transport speed of the recording medium M on which the recording head 41 performs the printing in the width direction in the printing region are stable, the printing is performed with a relatively high quality. In addition, since the elastic member 125 is made of elastomer, the back surface of the recording medium M is unlikely to be scratched even if the recording medium M slides on the elastic member 125.

In addition, in the configuration and the operation of the printer 11 described above, the inventors of the invention found that an amount of variation of an actual transport distance in the transport distance during the time of one pass is small and the amount of the variation is within an allowable limit value of when a difference in coefficients of static and dynamic friction of the first surface 25*a* of the support sliding section 25 with the recording medium M $\Delta\mu=0$ and when a difference in the coefficients of static and dynamic friction $\Delta\mu=0.1$. Therefore, it is preferable to satisfy the difference in the coefficients of static and dynamic friction $\Delta\mu\leq0.1$ so that the variation amount of the actual transport distance is within the allowable limit value or less. Here, the allowable limit value is a value determined from an allowable limit value of the deviation of the printing dots decided from required printing quality. Then, since the elastic member 125 made of elastomer satisfies the coefficient of friction $\Delta\mu\geq0.4$ and the difference in the coefficients of static and dynamic friction $\Delta\mu\leq0.1$ by evaluation of the inventors, in the embodiment, the first surface 25*a* is formed in the support sliding section 25 by using the elastic member 125 made of elastomer.

In the embodiment, for example, the elastic member 125 of the support sliding section 25 as the protruding section having the first surface 25*a* is made of elastomer. For example, a thermoplastic elastomer (TPE) of an EPT system is used as an example. Particularly, a sheet having a thickness of 0.5 mm and a black color which is available in a trade name "TPE sheet" and a product No. "TB965N" (made in Kureha Elastomer Co., Ltd.) can be used.

As described above, according to the embodiment, it is possible to obtain the following effects.

(1) The support sliding section 25, which has the elastic member 125 as the protruding section having the first surface 25*a* having the coefficient of friction with the recording medium M greater than that of the support surface 17*a* on the upstream side in the transport direction and the second surface 25*b* having the coefficient of friction lower than that of the first surface 25*a*, is disposed in the end portion of the discharging support section 17 on the downstream side in the transport direction. Therefore, the biased force during the time of winding is unlikely to propagate to the upstream side in the transport direction and, for example, the deviation of the recording medium M in the width direction is suppressed to be small in the printing region with the sliding resistance of the recording medium M with the first surface 25*a* of the elastic member 125 and with an appropriate holding force to a certain extent that the catch of the recording medium M in transporting does not occur by holding the recording medium M on the two sides facing each other along the transport direction in the first surface 25*a* of the elastic member 125 while bringing the recording medium M into line contact with the two sides. Thus, it is possible to print the image on the recording medium M with high quality. In addition, if the recording medium M slides on the first surface 25*a* and is displaced in the width direction, it is possible to suppress the amount of the displacement significantly in the width direction in the printing region in proportion to the amount of the displacement thereof by forming the support sliding section 25 including the first surface 25*a* in the end portion of the discharging support section 17 on the downstream side and providing the elastic member 125 in the farthest position from the printing region facing the recording head 41 in the transport direction on the support surface 17*a* on the downstream side.

(2) The difference (difference in the coefficients of static and dynamic friction) between the coefficient of static friction and the coefficient of dynamic friction between the first surface 25*a* of the elastic member 125 and the recording medium M $\Delta\mu$ is 0.1 or less ($\Delta\mu\leq0.1$). In addition, the length (width) W of the first surface 25*a* of the elastic member 125 is 20 mm or greater and the interval P between the adjacent elastic members 125, that is, the length of the second surface 25*b*, is 40 mm or greater. According to the configuration, even if the reflective metal M is deviated in the width direction by sliding on the first surface 25*a*, it is possible to reduce the catch which occurs during the time of transporting because the difference in the coefficients of static and dynamic friction $\Delta\mu$ is great and it is possible to transport the recording medium M with a relatively high positional accuracy while maintaining the stability of the transportation of the recording medium M.

(3) An elastomer is used as the elastic member 125. Therefore, the difference in the coefficients of static and dynamic friction $\Delta\mu$ of the elastic member 125 (the first surface 25*a*) can be 0.1 or less. Therefore, it is possible to suppress the deviation of the position of the recording medium M to be small in the width direction and it is possible to increase the positional accuracy of the transportation of the recording medium M. In addition, it is possible to perform the printing on the recording medium M with high quality by using the elastic member 125.

(4) In the end portion of the discharging support section 17 on the downstream side in the transport direction, the elastic member 125 has the first support surface section 61 on which the recording medium M that is discharged without winding and the recording medium M that is wound slide together and the second support surface section 62 which is formed of the convex-curved surface continuous with the first support surface section 61 on the downstream side in the transport direction, and on which the recording medium M that is discharged without winding does not slide but the recording medium M that is wound slides. Therefore, it is possible to reduce a frictional resistance force to be small which is received by sliding of the recording medium M discharged without winding with the support sliding section 25 in the end portion of the support surface 17*a* of the discharging support section 17 on the downstream side. For example, it is possible to reduce the catch of the recording medium M with the first surface 25*a* of the support sliding section 25 in the contact locations.

The foregoing describes in detail the embodiments of the invention made by the inventors but the invention is not limited to the above embodiments and modification examples thereof, and it is possible to make various modifications without departing from the spirit thereof.

For example, the above embodiments may be modified in the following forms.

The support sliding section 25 is not limited to the disposition of the above embodiments and may be disposed on the downstream side from the recording section 34 in the transport direction in the transportation path of the printer 11 (the recording apparatus).

The elastic member 125 is not limited to the elastomer and may be rubber, foamed resin or the like. For example, an elastic member such as urethane rubber, silicone rubber, NBR, or CR is preferably used.

In addition, the above embodiment is configured of the elastic member 125 as the protruding section having the first surface 25*a* of the support sliding section 25 but the invention is not limited to the above embodiment. As long as the difference between the coefficient of static friction and the coefficient of dynamic friction between the first surface and the recording medium is 0.1 or less and the recording medium is not scratched by the sliding of the recording medium on the first surface according to the transportation of the recording medium, the protruding section having the first surface may be formed by a member other than the elastic member.

In addition, a surface processing may be performed on the first surface of the protruding section to increase the coefficient of friction.

In addition, the above embodiment is configured of the elastic member 125 having the first surface 25*a* disposed on the second surface 25*b* of the support sliding section 25 but the invention is not limited to the embodiment, and, for example, the support sliding section may be formed in a manner in which a bottom portion of a concave section serves as the second surface by forming the concave section in a periphery of the first surface.

The elastic member 125 may be provided in the end portion of the discharging support section 17 on the downstream side so as to hold on the first support surface section 61 and not to hold on the second support surface section 62. In addition, conversely, the elastic member 125 (protruding section) may be provided so as to hold on the second support surface section 62 and not to hold on the first support surface section 61. According to the configuration, the recording medium M which is wound slides on the elastic member 125 and then the deviation of the position on the upstream side therefrom can be suppressed to be small, and it is easy to further avoid that the recording medium M which is not wound is caught on the elastic member 125.

The first support surface section 61 and the second support surface section 62 may be defined by setting the path M1 close to the outermost side to pass through on the side of the path M2 from the path M3 of the recording medium M which is wound.

The invention may be applied to a printer which does not include the tension roller 22 on the side of the winding section 18.

The recording apparatus is not limited to the ink jet type printer and may be a dot impact type printer and a laser type printer. Furthermore, the recording apparatus is not limited to the serial printer and may be a line printer or a page printer.

The recording apparatus may be a combined machine including a printing function, a scanner function and a copy function.

The recording medium is not limited to the resin film or the paper and may be a resin sheet, a metal foil, a metal film, a composite film (laminated film) of resin and metal, fabric, nonwoven fabric, ceramic sheet or the like as long as the recording medium is a long medium and is wound in a roll shape. In addition, the medium is not limited to the recording medium and may be a medium on which a processing other than the recording (printing) is performed. For example, the medium may be a tape-shaped substrate made of resin (for example, polyimide resin). In addition, the medium may be a single sheet medium rather than the roll-shaped medium.

The medium transportation device is not limited to being provided in the recording apparatus and may be provided in a processing apparatus which performs a processing other than the printing. For example, the medium transportation device may be employed in a drying apparatus which is transported in a dryer which dries the medium. In addition, the medium transportation device may be employed in a surface processing apparatus which performs a surface processing such as coating or surface modification processing on the medium. In addition, the medium transportation device may be employed in a processing apparatus which performs punching on the medium. Furthermore, the medium transportation device may be employed in a plating apparatus which performs electroless plating on the medium. The medium transportation device may be applied in a circuit forming apparatus which prints a circuit on a tape-shaped substrate. The medium transportation device may be employed in a measuring apparatus which obtains measurements such as the thickness and surface roughness of the medium. Furthermore, the medium transportation device may be employed in an inspection apparatus for inspecting the medium.

The support surface 17*a* of the discharging support section 17 and the first surface 25*a* (the second surface 25*b*) of the support sliding section 25 may be a flat surface rather than the curved surface. In addition, the support surface 17*a* and the first surface 25*a* (the second surface 25*b*) are not limited to the inclined surface descending on the downstream side in the transport direction and may be a flat surface extending in a substantially horizontal state parallel to the support surface of the recording support section, and may be an inclined surface ascending on the downstream side in the transport direction. In addition, the ascending inclined surface may be a concave surface in which the side of the processing surface (printing surface as an example) of the medium is concave or may be a convex surface in which the side of the processing surface of the medium is convex.

In the support sliding section 25, the shape of the elastic member 125 as the protruding section forming the first surface 25*a* is not limited to the substantially rectangular shape in a plan view as the above embodiment and may be another planar shape, for example, a polygon, or may be a shape including an arc contour. In addition, the shape of the cross-section of the elastic member 125 in the transport direction is not limited to the rectangular shape. The shape may be a triangle or an arc shape. In addition, as long as the plurality of elastic members 125 are disposed at intervals, regardless of any positions of the elastic members 125, a certain effect that suppresses the amount of the displacement of the recording medium M in the direction intersecting the transport direction can be obtained. However, in order to effectively suppress the displacement of the recording medium M in the direction intersecting the transport direction, it is preferable that the elastic members be symmetrically disposed in the direction intersecting the transport direction.

The entire disclosure of Japanese Patent Application No. 2013-020173, filed Feb. 5, 2013 is expressly incorporated by reference herein.

What is claimed is:

1. A medium transportation device comprising:

a transportation section that transports a medium in a transport direction;

a winding section that winds the medium transported by the transportation section; and a medium support section that is disposed between the transportation section and the winding section, and has a medium support surface supporting the medium, wherein the medium support section includes a support sliding section having a first surface and a second surface, a coefficient of friction of the first surface with the medium is greater than a coefficient of friction of the medium support surface with the medium, and a coefficient of friction of the second surface with the medium is lower than the coefficient of friction of the first surface with the medium, wherein the first surface includes protruding sections that protrude from the second surface.

2. The medium transportation device according to claim 1, wherein a difference between a coefficient of static friction and a coefficient of dynamic friction between the first surface and the medium is 0.1 or less.

3. The medium transportation device according to claim 1, wherein the protruding sections are disposed at intervals in a direction intersecting the transport direction, and wherein the protruding sections have sides along the transport direction.

4. The medium transportation device according to claim 3, wherein a total length of the plurality of first surfaces in the direction intersecting the transport direction is ½ or less of the length of the support sliding section in the direction intersecting the transport direction.

5. The medium transportation device according to claim 1, wherein a length of the first surface is 20 mm or greater and a length of the second surface is 40 mm or greater in the direction intersecting the transport direction.

6. The medium transportation device according to claim 1, wherein a distance between the first surface and the second surface in a thickness direction of the medium is 0.1 mm or greater.

7. The medium transportation device according to claim 1, wherein the protruding section is formed by an elastic member.

8. The medium transportation device according to claim 1, wherein if widths of the medium in the direction intersecting the transport direction are 16 inches, 24 inches, 36 inches, 48 inches, 53 inches, 61 inches and 64 inches, the protruding sections are disposed such that an end portion of the medium having at least one of those widths in the direction intersecting the transport direction is supported on the first surface.

9. The medium transportation device according to claim 8, wherein in every case where the widths of the medium which is supported in the support sliding section in the direction intersecting the transport direction are all 16 inches, 24 inches, 36 inches, 48 inches, 53 inches, 61 inches and 64 inches, the protruding sections are disposed such that the end portion of the medium in the direction intersecting the transport direction is supported on the first surface.

10. The medium transportation device according to claim 1, wherein the first surface is continuous with the medium support surface.

11. A recording apparatus comprising:

a recording section that performs recording on a medium;

a transportation section that transports the medium in a transport direction;

a winding section that winds the medium transported by the transportation section; and a medium support section that is disposed between the transportation section and the winding section, and has a medium support surface supporting the medium, wherein the medium support section has a plurality of protruding sections that include first surfaces having a coefficient of friction with the medium greater than that of the medium support surface and being disposed at intervals in a direction intersecting the transport direction; and a support sliding section formed of a second surface having a coefficient of friction with the medium lower than that of the first surface, wherein the plurality of protruding sections protrude from the second surface.

* * * * *